US012709714B2

(12) United States Patent
Fukui et al.

(10) Patent No.: US 12,709,714 B2
(45) Date of Patent: Aug. 18, 2026

(54) GASIFICATION FURNACE OPERATING METHOD AND GASIFICATION FURNACE

(71) Applicants: SHOWA DENKO K.K., Tokyo (JP); UBE CORPORATION, Ube (JP); EBARA ENVIRONMENTAL PLANT CO., LTD., Tokyo (JP)

(72) Inventors: Tomoaki Fukui, Tokyo (JP); Junichi Akiyama, Tokyo (JP)

(73) Assignees: Resonac Corporation, Tokyo (JP); UBE CORPORATION, Ube (JP); EBARA ENVIRONMENTAL PLANT CO., LTD., Tokyo (JP)

( * ) Notice: Subject to any disclaimer, the term of this patent is extended or adjusted under 35 U.S.C. 154(b) by 1100 days.

(21) Appl. No.: 17/785,682

(22) PCT Filed: Dec. 17, 2020

(86) PCT No.: PCT/JP2020/047249
§ 371 (c)(1),
(2) Date: Jun. 15, 2022

(87) PCT Pub. No.: WO2021/125289
PCT Pub. Date: Jun. 24, 2021

(65) Prior Publication Data

US 2023/0067815 A1 Mar. 2, 2023

(30) Foreign Application Priority Data

Dec. 19, 2019 (JP) ..... 2019-229389

(51) Int. Cl.
*C10J 3/48* (2006.01)
*C10J 3/54* (2006.01)
(Continued)

(52) U.S. Cl.
CPC ..... *C10J 3/487* (2013.01); *C10J 3/54* (2013.01); *C10J 3/721* (2013.01); *C10J 3/723* (2013.01);
(Continued)

(58) Field of Classification Search
CPC ..... C10J 3/487; C10J 3/54; C10J 3/721; C10J 3/723; C10J 2300/0946; C10J 2300/0983;
(Continued)

(56) References Cited

U.S. PATENT DOCUMENTS 4,410,365 A * 10/1983 Glukhovsky ..... C04B 28/08 106/606
4,521,890 A * 6/1985 Burnham ..... H05B 7/00 373/22
(Continued)

FOREIGN PATENT DOCUMENTS

JP 2003-074822 A 3/2003
JP 2003-212615 A 7/2003
(Continued)

OTHER PUBLICATIONS

International Search Report for PCT/JP2020/047249 dated Mar. 2, 2021.
(Continued)

*Primary Examiner* — David J Laux
(74) *Attorney, Agent, or Firm* — Sughrue Mion, PLLC

(57) ABSTRACT

Provided are a gasification furnace operating method, a gasification furnace, a two-stage gasification apparatus, a gasification method for an organic raw material, and a two-stage gasification method for organic waste that make it possible to stably operate a gasification furnace over a long period of time. The present invention provides a gasification furnace operating method including, in a gasification furnace into which an organic raw material is introduced and
(Continued)

that produces gas and slag, directly or indirectly introducing an alkali metal-containing compound into the gasification furnace to reduce the viscosity of the slag.

11 Claims, 2 Drawing Sheets

(51) Int. Cl.
*C10J 3/72* (2006.01)
*F23G 5/027* (2006.01)
*F23G 5/16* (2006.01)
*F23J 1/08* (2006.01)

(52) U.S. Cl.
CPC ..... *F23G 5/027* (2013.01); *F23G 5/16* (2013.01); *F23J 1/08* (2013.01); *C10J 2300/0946* (2013.01); *C10J 2300/0983* (2013.01); *C10J 2300/1625* (2013.01); *F23G 2201/40* (2013.01); *F23G 2202/103* (2013.01); *F23G 2203/50* (2013.01); *F23G 2900/55005* (2013.01)

(58) Field of Classification Search
CPC ..... C10J 2300/1625; C10J 2300/0906; C10J 2300/0956; C10J 2300/0959; C10J 2300/0986; C10J 3/526; C10J 3/66; C10J 3/845; F23G 5/027; F23G 5/16; F23G 2201/40; F23G 2202/103; F23G 2203/50; F23G 2900/55005; F23J 1/08; F23J 15/022; F23J 2217/50; F23J 9/00; C10K 1/08; F23D 2214/00; C02F 11/10; B09B 3/40; Y02W 30/20
See application file for complete search history.

(56) References Cited

U.S. PATENT DOCUMENTS

| | | | | |
|---|---|---|---|---|
| 8,353,698 | B2 * | 1/2013 | Moberg | B01D 53/56 431/11 |
| 2002/0020112 | A1 * | 2/2002 | Stivers | C10J 3/16 48/198.2 |
| 2019/0225544 | A1 * | 7/2019 | Kriven | C04B 28/26 |

FOREIGN PATENT DOCUMENTS

| | | | |
|---|---|---|---|
| JP | 2004-183921 | A | 7/2004 |
| JP | 2008-63185 | A | 3/2008 |
| JP | 2009-226237 | A | 10/2009 |
| KR | 1998-023905 | A | 7/1998 |

OTHER PUBLICATIONS

"Chinese Master's Theses Full-text Database, Engineering Science and Technology I", Jun. 15-16, 2012, pp. 1-69 (80 pages total).

* cited by examiner

GASIFICATION FURNACE OPERATING METHOD AND GASIFICATION FURNACE

CROSS REFERENCE TO RELATED APPLICATIONS

This application is a National Stage of International Application No. PCT/JP2020/047249 filed Dec. 17, 2020, claiming priority based on Japanese Patent Application No. 2019-229389 filed Dec. 19, 2019.

FIELD

The present disclosure relates to a method for operating a gasification furnace, a gasification furnace, a two-stage gasification system, a method for gasifying an organic raw material, and a method for two-stage gasifying organic waste, which can be suitably used for gasification treatment of organic waste, such as waste plastic.

BACKGROUND

A conventional gasification furnace used for gasification treatment of organic waste, such as waste plastic, municipal waste, sewage sludge, waste FRP, biomass waste, automobile waste, and a waste oil is provided with an non-combustible material separation chamber below a combustion chamber of the gasification furnace in order to separate gas containing hydrogen gas, carbon monoxide gas, etc., and slag containing ash. A throat portion having a cross-sectional area smaller than that of the combustion chamber is provided between the combustion chamber and the non-combustible material separation chamber, so that the residence time of the gas to be cooled is shortened, that is, the linear velocity of the gas is increased in order to suppress the de novo synthesis of dioxin in the gasification furnace.

Most of the slag formed in the combustion chamber flow down along a side wall of a cylindrical combustion chamber in a molten state (hereinafter slag in a molten state is referred to as "molten slag") to reach the non-combustible material separation chamber through the throat portion, and the remainder also reaches the non-combustible material separation chamber through the throat portion while being entrained in the gas. The molten slag is coarsened by being quenched by cooling water of the non-combustible material separation chamber, and is taken from a slag outlet at the bottom of the gasification furnace as coarse grained slag.

When the composition and the supply rate of the organic raw material supplied to the gasification furnace change, a temperature in the combustion chamber may change, or the melting point or the viscosity of formed slag may change. In such a case, a lot of molten slag flow into the throat portion from an opening at the bottom of the combustion chamber at a time, and the throat portion or a cylindrical downcomer connected to the throat portion so as to extend downward from the throat portion may be clogged or narrowed temporarily. When the temperature in the combustion chamber rises rapidly, the slag which has been adhered to the side wall of the combustion chamber becomes molten slag to flow down along the side wall, and a lot of molten slag flow into the throat portion at a time, so that the throat portion or the cylindrical downcomer may be clogged.

To a side wall of a connection between the throat part and the non-combustible material Its separation chamber, a fine slag droplet entrained in the gas (slag mist) is adhered, in some cases to form a large slag lump. When the slag lump falls into the non-combustible material separation chamber, the slag outlet of the non-combustible material separation chamber may be clogged.

When the throat portion, the cylindrical downcomer or the slag outlet is clogged even temporarily, or the throat portion or the cylindrical downcomer is narrowed, the internal pressure of the gasification furnace increases, so that it may be necessary to stop the operation of the gasification furnace, or to reduce the supply rate of the organic raw material, from the viewpoint of safety. When the slag outlet is clogged by the slag lump, the operation of the gasification furnace must be stopped to clean the inside of the non-combustible material separation chamber, so that the operation efficiency decreases.

Patent Literature 1 describes a method for operating a gasification melting and reforming furnace in which waste is gasified and melted in the gasification melting and reforming furnace, and formed gas is gas-reformed in the reforming furnace at a temperature of 1,000 to 1,300° C., wherein when the degree of basicity ($CaO/SiO_2$) of ash is 1.0 or more, a powdery/granular material which is rich in $SiO_2$ is added to the waste before the gasification melting furnace, or added to the formed gas in the gasification melting furnace before the reforming furnace, as a melting accelerator.

CITATION LIST

Patent Literature

[PTL 1] JP 2009-226237 A

SUMMARY

Technical Problem

Patent Literature 1 focuses on a ratio of calcium and silicon (the degree of basicity of ash), and there is a limit to a waste composition which can be applied, such as not applicable to organic waste having a low calcium content.

By lowering the operating temperature of the gasification furnace (combustion temperature), it may be possible to increase useful components, such as hydrogen gas, and carbon monoxide gas, which are contained in the formed gas. However, lowering the operating temperature of the gasification furnace, the fluidity of molten slag is reduced, clogging or narrowing of the throat portion or the cylindrical downcomer is more likely to occur. The molten slag with the reduced-fluidity becomes a larger droplet and falls, and is quenched by the cooling water of the non-combustible material separation chamber, resulting in coarse grained slag having a larger diameter, The slag outlet may be easily clogged by the slag having a larger diameter.

The present invention provides a method for operating a gasification furnace, a gasification furnace, a two-stage gasification system, a method for gasifying an organic raw material, and a method for two-stage gasifying organic waste, which enable to operate the gasification furnace stably for a long period of time.

Solution to Problem

As a result of intensive investigation, the present inventors have found that the viscosity of slag can be reduced by charging an alkali metal-containing compound directly or indirectly into the gasification furnace to suppress or prevent clogging or narrowing of the throat portion or the cylindrical downcomer, or clogging of the bottom of the gasification furnace, thereby completing the present invention.

The present disclosure encompasses the following aspects.

A method for operating a gasification furnace in which an organic raw material is charged to form gas and slag, comprising charging an alkali metal-containing compound directly or indirectly into the gasification furnace to reduce the viscosity of the slag.

[1] The method according to [1], wherein the alkali metal-containing compound is sodium silicate.

[2] The method according to [2], wherein the sodium silicate is charged in the form of an aqueous solution.

[3] The method according to [2] or [3], wherein the molar ratio of silicon dioxide and sodium oxide in the sodium silicate (the number of moles of silicon dioxide/the number of moles of sodium oxide) is 0.4 or more and 4.5 or less.

[5] The method according to any one of [1] to [4], comprising charging a silicon containing compound directly or indirectly to the gasification furnace.

[6] The method according to [5], wherein the silicon containing compound is a bed material.

[7] The method according to any one of [2] to [6], wherein the molar ratio of silicon dioxide and sodium oxide (the number of moles of silicon dioxide/the number of moles of sodium oxide) in the slag having a reduced viscosity is 1.0 or more and 15.0 or less.

[8] The method according to any one of [1] to [7], wherein the slag having a reduced viscosity comprises an alkali metal in an amount of 1.5% by mass to 20.0% by mass in terms of in oxide.

[9] The method according to any one of [2] to [8], comprising analyzing the content of sodium and silicon of the slag, and charging the alkali metal-containing compound, when the molar ratio of silicon dioxide and sodium oxide in the slag (the number of moles of silicon dioxide/the number of moles of sodium oxide) is 2.5 or less.

[10] The method according to any one of [1] to [9], comprising mixing the alkali metal-containing compound with the organic raw material, and charging the mixture into the gasification furnace.

[11] A gasification furnace for forming gas and slag from an organic raw material, comprising a combustion chamber for gasifying or combusting the organic raw material, a non-combustible material separation chamber for cooling and recovering the formed slag, and an inlet for an alkali metal-containing compound provided in the combustion chamber.

[12] The gasification furnace according to [11], wherein the inlet comprises a double tube having an outer tube and an inner tube, and wherein the alkali metal-containing compound is supplied to the inner tube, and an inert gas is supplied to the outer tube.

[13] The gasification furnace according to [11] or [12], wherein the inlet is disposed on a side of the combustion chamber.

[14] The gasification furnace according to any one of [11] to [13], wherein the gasification furnace is a swirling melting furnace.

[15] A two-stage gasification system for organic waste, comprising a low temperature gasification furnace which forms an organic raw material by primary gasification of the organic waste, and a high temperature gasification furnace which forms gas and slag by secondary gasification of the organic raw material formed in the low temperature gasification furnace, wherein the high temperature gasification furnace is the gasification furnace according to any one of [11] to [14].

[16] The two-stage gasification system according to [15], wherein the low temperature gasification furnace is a fluidized bed gasification furnace.

[17] A method for two-stage gasifying organic waste, comprising forming an organic raw material by primary gasification of the organic waste in a low temperature gasification furnace, charging the organic raw material into a high temperature gasification furnace, forming gas and slag by secondary gasification of the organic raw material in the high temperature gasification furnace, and charging an alkali metal-containing compound directly or indirectly into the high temperature gasification furnace to reduce the viscosity of the slag.

[18] The method according to [17], wherein the high temperature gasification furnace is the gasification furnace according to any one of [11] to [14],

[19] The method according to [17] or [18], wherein the low temperature gasification furnace is a fluidized bed gasification furnace.

Advantageous Effects of Invention

According to the invention of the present disclosure, clogging or narrowing of the throat portion or the cylindrical downcomer, or clogging of the bottom of the gasification furnace is suppressed or prevented by charging an alkali metal-containing compound directly or indirectly into the gasification furnace to reduce the viscosity of slag, whereby the gasification furnace can be operated stably for a long period of time.

DESCRIPTION OF EMBODIMENTS

Figure 1:
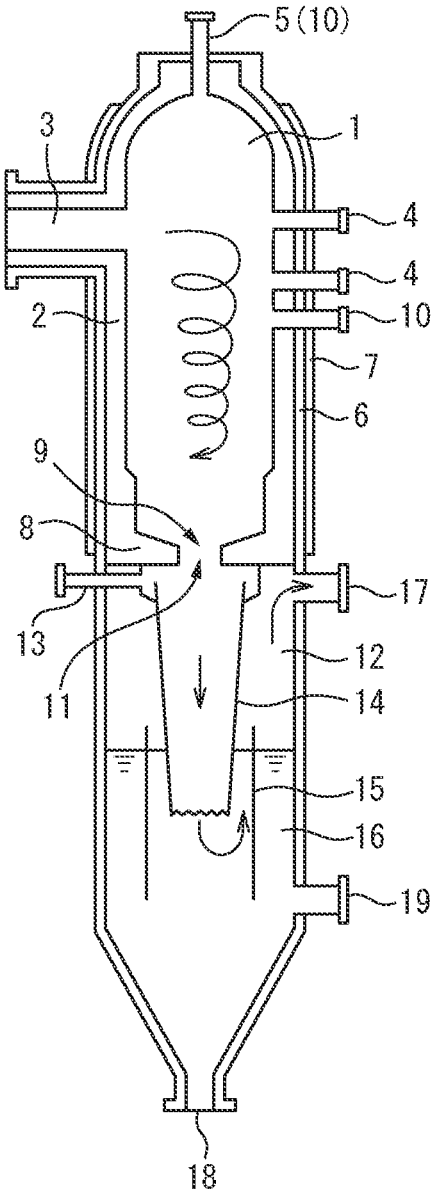
FIG. 1 shows a schematic cross-sectional view of a gasification furnace according to one embodiment.

Although embodiments of the present invention will be described below, the present invention is not limited to these embodiments, and various applications are possible within the spirit and practice of the present invention.

In one embodiment, a method for operating a gasification furnace in which an organic raw material is charged to form gas and slag comprises charging an alkali metal-containing compound directly or indirectly into the gasification furnace to reduce the viscosity of the slag.

The gasification furnace is not particularly limited as long as it produces gas and slag from an organic raw material. The gasification furnace includes, for example, an ash melting furnace (electric, burner, sub material melting, etc.) for melting a residue, such as ash after incinerating waste in an incinerator, and a gasification melting furnace (a direct melting furnace for simultaneously gasifying and melting waste, a fluidized bed gasification melting furnace for melting after gasifying waste, a kiln-type gasification melting furnace, a pusher gasification melting furnace, etc.). According to classification by a heat source of the gasification furnace, for example, an electric melting furnace (an AC arc melting furnace, an AC electric resistance melting furnace, a DC electric resistance melting furnace, a plasma melting furnace, an induction type melting furnace, etc.), a fuel combustion type melting furnace (a rotary surface melting furnace, a reflective surface melting furnace, a radiative surface melting furnace, a swirling flow melting furnace, a rotary kiln-type melting furnace, a coke bed ash melting furnace, etc.), and a direct combustion melting furnace (a coke bed-type refuse melting furnace, a pyrolysis and swirling flow melting furnace, an internal melting furnace, etc.) may be mentioned. The gasification furnace may be a high temperature gasification furnace of a gasification plant (a gasification and reforming plant, etc.), Which forms valuable gas (hydrogen gas, carbon monoxide gas, etc.) from organic waste.

In one embodiment, the gasification furnace comprises a combustion chamber for gasifying or combusting an organic raw material, a non-combustible material separation chamber for cooling and recovering formed slag, and an inlet for an alkali metal-containing compound provided in the combustion chamber. The gasification furnace is preferably a swirling melting furnace.

In one embodiment, the gasification furnace is a high temperature gasification furnace in a two-stage gasification system which gasifies organic waste, such as waste plastic, municipal waste, sewage sludge, waste FIS', biomass waste, automobile waste, a waste oil, etc., as waste. In the high temperature gasification furnace, syngas (also referred to as fuel gas), such as hydrogen gas, and carbon monoxide gas; and slug containing an oxide, such as oxides of aluminum, silicon, calcium, iron, etc., as ash are formed from an organic raw material. The organic raw material may be charged into the high temperature gasification furnace along with a material, in addition to the organic waste or hydrocarbon gas, other than the organic raw material, such as hydrogen gas, carbon monoxide gas, tar, combustible carbonaceous particles (char), and particles containing a non-combustible material (ash). The organic raw material may be in the form of combustible gas which entrains combustible carbonaceous particles, and particles containing a non-combustible material.

Hereinafter, as an exemplary gasification furnace, a high temperature gasification furnace of a two-stage gasification system for organic waste will be described in detail.

The two-stage gasification system comprises a low temperature gasification furnace which forms an organic raw material by primary gasification of organic waste, and a high temperature gasification furnace which forms gas and slag by secondary gasification of the organic raw material formed in the low temperature gasification furnace.

FIG. 1 shows a schematic cross-sectional view of a gasification furnace (a high temperature gasification furnace) according to one embodiment. The gasification furnace is a swirling melting furnace, and generally comprises a combustion chamber 1 having a cylindrical shape, a throat portion 11, and a non-combustible material separation chamber 12. The combustion chamber 1 comprises on a side wall 2, an organic raw material inlet 3, and a gasification agent inlet 4 for supplying a gasification agent, usually a mixed gas of oxygen gas and water vapor, for combusting the organic raw material, and, at the top of the combustion chamber 1, a top gasification agent inlet 5 for supplying oxygen or water vapor, which may be insufficient at the upper portion of the combustion chamber 1. In FIG. 1, although two gasification agent inlets 4 are shown, the number of the gasification agent inlet 4 is not particularly limited.

The organic raw material inlet 3, and the gasification agent inlet 4 are disposed on the side wall 2, so that the organic raw material supplied to the combustion chamber 1 descends while swirling around an axis extending in the vertical direction of the combustion chamber 1. The organic raw material supplied to the combustion chamber 1 forms a swirling flow containing a large amount of particulate combustible components in the outer circumference side, and a swirling flow containing a large amount of gaseous combustible components in the inner circumference side. Gasification of the particulate combustible component is promoted by supplying a gasification agent, such as oxygen gas, through the gasification agent inlet 4 on the side wall 2 toward the swirling flow containing a large amount of the particulate combustible components on the outer circumference side.

In FIG. 1, the periphery of the side wall 2 of the combustion chamber 1 is covered with a steel outer 6, and further its outside is covered with a cooling jacket 7 in through which a cooling medium passes. Although the side wall 2 is formed of a refractory (usually a castable refractory), the surface may be scraped by the erosion action of molten slag, etc. In this case, by lowering the temperature of the side wall 2 to a vicinity of the melting point of the molten slag by the cooling medium to fix the molten slag, the erosion of the side wall 2 can be suppressed (self-coating by slag). The cooling medium is not particularly limited, but boiler water is usually used, and a portion of the boiler water in the cooling jacket 7 is present as water vapor.

The bottom 8 of the combustion chamber 1 is formed of a refractory (usually a castable refractory) similar to the side wall 2, and the throat portion 11 is disposed at the boundary between the combustion chamber 1 and the non-combustible material separation chamber 12 of the gasification furnace. In FIG. 1, although an opening 9 of the combustion chamber 1 is provided at the axial position of the combustion chamber 1, the opening 9 may be provided eccentrically from the axial position of the combustion chamber 1 (so that the center of the opening is positioned around the axial position of the combustion chamber 1).

The upper portion of the side wall 2 of the gasification furnace, in which the thickness of the refractory is likely to decrease, is preferably lined with 10 to 80% by mass $Cr_2O_3$—$Al_2O_3$ castable. The lower portion of the side wall 2 of the gasification furnace, and the bottom 8 of the combustion chamber 1 can be lined with 10 to 30% by mass $Cr_2O_3$—$Al_2O_3$ castable.

In the non-combustible material separation chamber 12, the lower tip of a cylindrical downcomer 14, which is connected to the throat portion 11 so as to extend downward from the throat portion 11, extends so as to submerge in cooling water of a water tank portion 16. Gas and molten slag passing through the throat portion 11 are blown into the cooling water of the water tank portion 16. Around the cylindrical downcomer 14, a cylindrical riser tube 15 having a larger inner diameter than the outer diameter of the cylindrical downcomer 14 is installed concentrically with the cylindrical downcomer 14. The gas blown into the cooling water of the water tank portion 16, through between the cylindrical downcomer 14 and the cylindrical riser tube 15, is recovered from a gas extraction port 17 provided on a side of the non-combustible material separation chamber 12.

The cooling water of the water tank portion 16 is supplied through a cooling water inlet pipe 13. The cooling water supplied through the cooling water inlet pipe 13 flows down the inner wall surface of the cylindrical downcomer 14, and accumulates in the water tank portion 16. The cooling water accumulated in the water tank portion 16 is discharged to the outside from a cooling water extraction port 19 provided on a side of the water tank portion 16. The molten slag blown into the cooling water of the water tank portion 16 is quenched by the cooling water of the water tank portion 16 to become a slag grain (coarse grained slag), and the grain is taken out from a slag outlet 18 provided at the bottom of the water tank portion 16. The temperature of the cooling water is preferably 150 to 160° C. Thus, high temperature gas and molten slag are quenched to 200° C. or less.

Although the cylindrical downcomer 14 has a smaller inner diameter downward, and its lower tip is shown so as to have a sawtooth shape in FIG. 1, the shape of the cylindrical downcomer 14 is not particularly limited. The inner wall surface of the cylindrical downcomer 14 is preferably shaped, such that the cooling water flows down while swirling. Thus, the high temperature gas can effectively come into contact with the cooling water on the inner surface of the cylindrical downcomer 14 to cool the gas efficiently.

The non-combustible material separation chamber 12 shown in FIG. 1 is exemplary, and it is not necessary to cool gas with cooling water. For example, the heat of the gas may be recovered by a radiant boiler for use in power generation, etc.

The temperature in the combustion chamber 1 of the gasification furnace is preferably 1,200° C. or more and 1,600° C. or less, more preferably 1,250° C. or more and 1,550° C. or less, and still more preferably 1,350° C. or more and 1,450° C. or less.

The internal furnace pressure of the gasification furnace is preferably 0.5 MPaG (gage pressure) or more and 9.0 MPaG or less, and more preferably 0.8 MPaG or more and 2.0 MPaG or less. When the internal furnace pressure of the gasification furnace is 9.0 MPaG or less, the proper combustion temperature can be ensured, and therefore the gasification treatment can be economically carried out without excessively increasing the facility cost from the viewpoint of pressure resistance and heat resistance. When the internal furnace pressure of the gasification furnace is 0.5 MPaG or more, the facility can be miniaturized as compared with the case where the gasification treatment is carried out at normal pressure.

The alkali metal-containing compound may be directly charged into the gasification furnace, or may be indirectly charged into the gasification furnace by mixing with an organic raw material to be charged into the gasification furnace. It is preferable that the alkali metal-containing compound be directly charged into the gasification furnace from the viewpoint of effective utilization of energy related to transport of the alkali metal-containing compound, etc., since the alkali metal-containing compound can efficiently reach the gasification furnace.

In FIG. 1, an inlet for an alkali metal-containing compound 10 is disposed on a side of the combustion chamber 1 of the gasification furnace. The inlet for an alkali metal-containing compound 10 may be disposed in the upper portion of the combustion chamber 1 of the gasification furnace instead of, or in addition to, the top gasification agent inlet 5. A plurality of inlets for an alkali metal-containing compound 10 may be provided. The alkali metal-containing compound can be directly charged into the gasification furnace through the inlet for an alkali metal-containing compound 10. By charging the alkali metal-containing compound through the inlet for an alkali metal-containing compound disposed on the side or the upper portion of the combustion chamber 1, the alkali metal-containing compound can be effectively mixed into the organic raw material or the molten slag in a high temperature state.

The inlet for an alkali metal-containing compound 10 may comprise a double tube having an outer tube and an inner tube. By supplying an alkali metal-containing compound to the inner tube of the double tube, and supplying an inert gas to the outer tube of the double tube, the alkali metal-containing compound can be dispersed or, when the alkali metal-containing compound is in the form of an aqueous solution, atomized, to be charged more uniformly into the gasification furnace.

Using the inlet for an alkali metal-containing compound 10 having the double tube, an alkali metal-containing compound may be supplied to the inner tube of the double tube, and a gasification agent or water vapor may be supplied to the outer tube of the double tube. Thus, the inlet for an alkali metal-containing compound 10, and the gasification agent inlet 4 or the top gasification agent inlet 5 can be provided at the same position in the gasification furnace.

When an alkali metal-containing compound is mixed with an organic raw material to be charged into a gasification furnace, for example, the inlet for an alkali metal-containing compound is provided upstream of the organic raw material inlet 3, and the alkali metal-containing compound can be added therethrough to the organic raw material and mixed therewith.

Examples of the alkali metal-containing compound include alkali metal hydroxides, such as sodium hydroxide, and potassium hydroxide, alkali metal carbonates, such as sodium carbonate, and potassium carbonate, alkali metal bicarbonates, such as sodium hydrogen carbonate, and potassium hydrogen carbonate, and alkali metal silicates, such as sodium silicate, and potassium silicate. The alkali metal-containing compound is preferably a sodium containing compound, since it is inexpensive, more preferably sodium hydroxide, and sodium silicate, since they are stable during storage, and still more preferably sodium silicate, since it has less influence on the refractory forming the side wall 2 of the combustion chamber 1.

The alkali metal-containing compound is preferably charged in the form of an aqueous solution, since it is easy to directly charge the alkali metal-containing compound into the gasification furnace, or it is possible to mix the alkali metal-containing compound more uniformly with an organic raw material. For example, sodium hydroxide may be an aqueous solution of 5% by mass to 50% by mass. Sodium silicate can be charged in the form of an aqueous solution, i.e., as a water glass.

With respect to the molar ratio of silicon dioxide and sodium oxide in sodium silicate (the number of moles of silicon dioxide/the number of moles of sodium oxide), silicon dioxide is preferably 0.4 or more and 4.5 or less, more preferably 1.2 or more and 3.5 or less, and still more preferably 2.3 or more and 3.3 or less, when sodium oxide is 1. When the molar ratio of silicon dioxide and sodium oxide in sodium silicate is within the above ranges, the fluidity of slag can be effectively increased. The masses of silicon dioxide and sodium oxide are determined according to the method prescribed in JIS K 1408:1966.

The mass of silicon dioxide in sodium silicate is preferably 19.0% by mass or more and 40.0% by mass or less, more preferably 21.0% by mass or more and 35.0% by mass or less, and still more preferably 23.0% by mass or more and 30.0% by mass or less.

The mass of sodium oxide in sodium silicate is preferably 5.0% by mass or more and 30% by mass or less, more preferably 7.0% by mass or more and 25.0% by mass or less, and still more preferably 9.0% by mass or more and 15.0% by mass or less.

The specific gravity of sodium silicate at 15° C. is preferably 30 or more, more preferably 35 or more, and still more preferably 38 or more. The specific gravity of sodium silicate is determined using the Baume hydrometer for heavy liquid prescribed in JIS Z 8804:2012.

The amount of the alkali metal-containing compound used is preferably 0.5 parts by mass or more and 20.0 parts by mass or less, more preferably 1.0 parts by mass or more and 15.0 parts by mass or less, and still more preferably 3.0 parts by mass or more and 12.0 parts by mass or less, with respect to 100 parts by mass of the molten slag before the alkali metal-containing compound is charged.

The alkali metal-containing compound is preferably introduced, so that the temperature of the throat portion is higher than the flow temperature of slag. Thus, the solidification of slag in the throat portion can be prevented, and therefore maintenance work, such as scraping of the solidified slag, can be eliminated or reduced.

The input amount of the alkali metal-containing compound can also be controlled based on the differential pressure in the throat portion, and the discharge amount of the coarse grained slag.

Further, a silicon containing compound (except for a silicon containing compound corresponding to the aforementioned alkali metal-containing compound, for example, sodium silicate, etc.) may be directly charged into the gasification furnace, and may be indirectly charged into the gasification furnace by mixing with an organic raw material to be charged into the gasification furnace. Examples of the silicon containing compound include silica sand, a silicate other than an alkali metal silicate, and a siloxane compound. The silicon containing compound may be a bed material. A two-stage gasification system of one embodiment as described below has a low temperature gasification furnace as a previous process of the gasification furnace (a high temperature gasification furnace). When the low temperature gasification furnace is a fluidized bed gasification furnace, a bed material, such as silica sand, olivine sand, and alumina, may be used. The bed material used in the previous process may be charged into the gasification furnace by being moved from the previous process along with an organic raw material.

The molar ratio of silicon dioxide and sodium oxide in the slag having a reduced viscosity (the number of moles of silicon dioxide/the number of moles of sodium oxide) is preferably 1.0 or more and 15.0 or less, more preferably 2.0 or more and 10.0 or less, and still more preferably 2.5 or more and 8.0 or less.

In one embodiment, the contents of sodium and silicon of the slag are analyzed, and an alkali metal-containing compound is charged, when the molar ratio of silicon dioxide and sodium oxide in the slag (the number of moles of silicon dioxide/the number of moles of sodium oxide) is 2.5 or less. Thus, the molar ratio of silicon dioxide and sodium oxide in the slag having a reduced viscosity can be maintained in the above preferred ranges to operate the gasification furnace stably for a long period of time. Slag sampling can be carried out from the bottom of the gasification furnace. The components of the slag can also be estimated from the components of a representative sample of organic waste or an organic raw material, and the operational performance of the gasification furnace.

The slag having a reduced viscosity preferably comprises an alkali metal in an amount of 1.5% by mass or more and 20.0% by mass or less, more preferably 3.0% by mass or more and 15.0% by mass or less, and still more preferably 5.0% by mass or more and 10.0% by mass or less, in terms of oxide.

The iron content of the slag having a reduced viscosity is preferably less than 6.0% by mass, more preferably less than 5.5% by mass, and still more preferably less than 5.0% by mass, in terms of oxide ($Fe_2O_3$). When the iron content of the slag having a reduced viscosity is within the above ranges, it is possible to effectively use coarse grained slag as a resource, even when treating it as industrial waste, the specific gravity of coarse grained slag can be a range suitable for treatment.

In one embodiment, main components of slag are aluminum oxide ($Al_2O_3$), and silicon dioxide ($SiO_2$). By adding an alkali metal, and, if necessary, silicon to slag containing aluminum oxide, and silicon dioxide as the main components to change the component ratio of the slag, a softening point, a melting point, and a flow temperature of the slag can be more effectively lowered. Thus, it is possible to suppress or prevent clogging or narrowing of the throat portion, or clogging of the bottom of the gasification furnace, In one embodiment, the change in the flow temperature due to a component change in molten slag behaves similar to that of a ternary system of aluminum oxide/silicon dioxide/sodium oxide. In this embodiment, a triangular diagram showing the relationship between the component ratio and the flow temperature of the ternary system of aluminum oxide/silicon dioxide/sodium oxide can be used to determine the composition and the added amount of an alkali metal-containing compound required to reduce the viscosity of slag.

In one embodiment, components and composition of molten slag prior to the charge of an alkali metal-containing compound are as follows:

$Al_2O_3$: 10% by mass to 50% by mass
$SiO_2$: 20% by mass to 60% by mass
$Na_2O$: 0.1% by mass to 20% by mass
CaO: 1% by mass to 20% by mass
$TiO_2$: 1% by mass to 15% by mass
$Fe_2O_3$: 1% by mass to 10% by mass
Remainder (MgO, etc.)

In one embodiment, an alkali metal-containing compound is charged, when a $Na_2O$ concentration in slag during the gasification treatment is less than 10% by mass, preferably less than 5.0% by mass, more preferably less than 3.0% by mass, and still more preferably less than 1.5% by mass. Slag sampling can be carried out from the bottom of the gasification furnace.

In one embodiment, a method for two-stage gasifying organic waste comprises forming an organic raw material by primary gasification of the organic waste in a low temperature gasification furnace, charging the organic raw material into a high temperature gasification furnace, forming gas and slag by secondary gasification of the organic raw material in the high temperature gasification furnace, and charging an alkali metal-containing compound directly or indirectly into the high temperature gasification furnace to reduce the viscosity of the slag.

Figure 2:
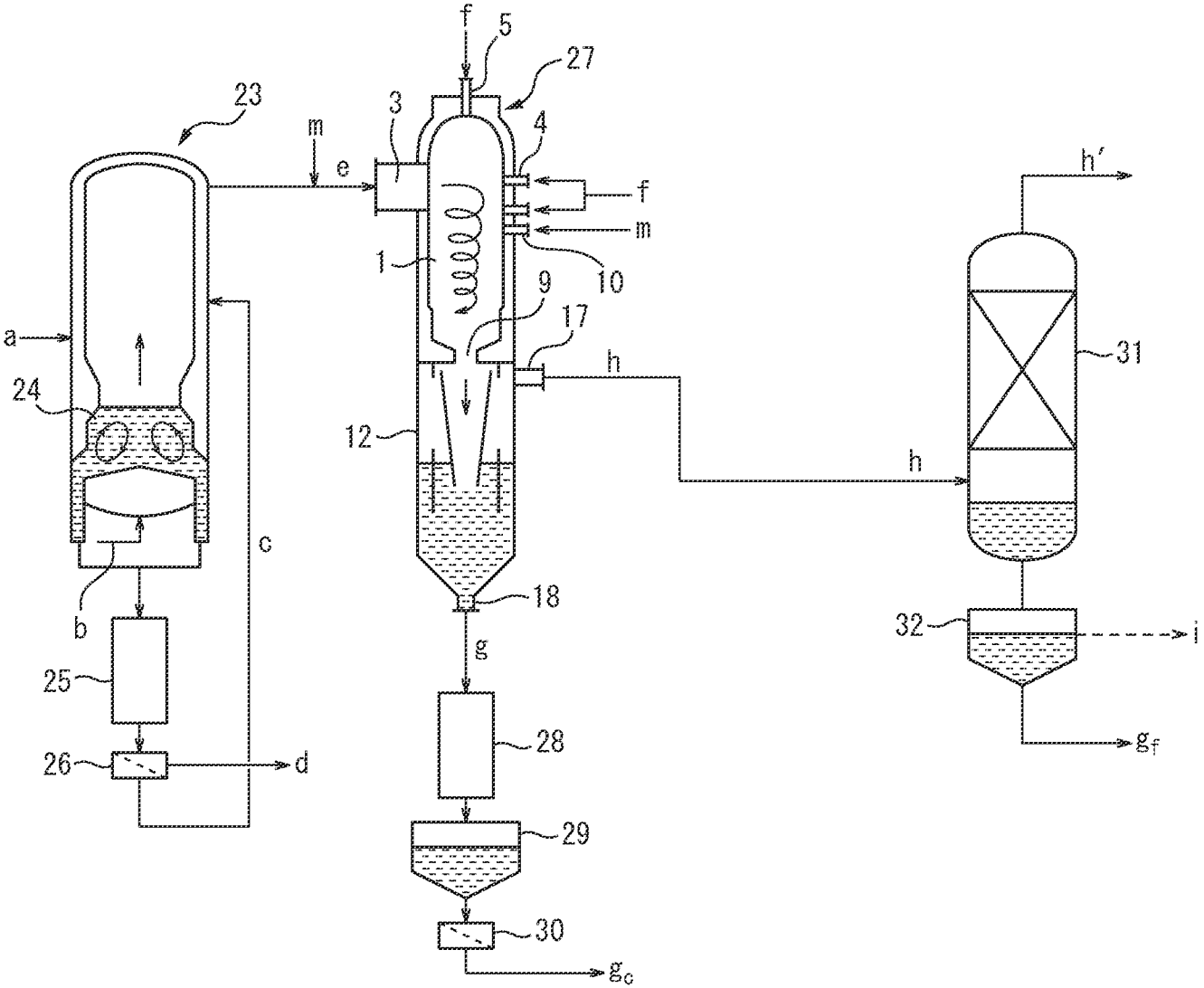
FIG. 2 shows a block diagram of a two-stage gasification system for organic waste comprising a gasification furnace according to one embodiment.

FIG. 2 shows a block diagram of a two-stage gasification system for organic waste comprising a gasification furnace according to one embodiment. The two-stage gasification system comprises a low temperature gasification furnace 23, and a high temperature gasification furnace 27. The high temperature gasification furnace 27 is a gasification furnace which is an objective of the present disclosure, as already described. The type of the low temperature gasification furnace is not particularly limited, and a stoker furnace or a fluidized bed gasification furnace is preferable, a fluidized bed gasification furnace is more preferable, and a pressurized fluidized bed gasification furnace is still more preferable. In FIG. 2, the low temperature gasification furnace 23 is shown as a fluidized bed gasification furnace having a fluidized bed 24.

The organic waste is not particularly limited, but is preferably at least one selected from the group consisting of waste plastic, municipal waste, sewage sludge, biomass waste, waste fiber reinforced plastic (FRP), automobile waste, industrial waste, steel slag, and solidified fuel. The organic waste is more preferably Refuse Derived Fuel (hereinafter also referred to as "RDF"), which is solidified fuel of municipal waste, or Refuse Paper & Plastic Fuel (hereinafter also referred to as "RPF"), which is solidified fuel of waste plastic, from the viewpoint of transportation efficiencies, and still more preferably RPF from the viewpoints of low compositional variation, high calorific value, and low water content. A plurality types of the organic waste may be combined.

Coal, petroleum fuel, etc., can be used as an auxiliary fuel for the organic waste.

The organic waste may be supplied to the low temperature gasification furnace 23 as a pellet which have been crushed to a size on the order of 5 mm to 30 mm, and optionally compressed. Liquid organic waste can be directly supplied to the low temperature gasification furnace 23.

Inside the low temperature gasification furnace 23, a bed material (for example, sand, such as silica sand, and olivine sand, alumina, iron powder, limestone, dolomite, etc.) fluidized by fluidizing gas b supplied from below the furnace forms a fluidized bed 24. As the fluidizing gas b, generally, oxygen gas, air, water vapor, or mixed gas thereof is used. The oxygen gas or air supplied as the fluidizing gas b also acts as a gasification agent for the organic waste. The organic waste a supplied to the low temperature gasification furnace 23 is quickly partially combusted (incompletely combusted) by the oxygen gas or air supplied to the furnace in the fluidized bed 24 maintained at a temperature of 450 to 850° C. (e.g., 600° C.) to form, for example, a part of an organic raw material (hydrocarbon gas, etc.), and hydrogen gas, carbon monoxide gas, tar, combustible carbonaceous particles, etc. Heat generated by this partial combustion is utilized to maintain the temperature in the low temperature gasification furnace.

The amount of air or oxygen supplied to the low temperature gasification furnace 23 is preferably 5% or more and 30% or less, and more preferably 10% or more and 20% or less, of the theoretical oxygen amount necessary for completely combusting the organic waste, The internal furnace temperature of the low temperature gasification furnace 23 is preferably 450° C. or more and 850° C. or less, and more preferably 600° C. or more and 800° C. or less. When the internal furnace temperature of the low temperature gasification furnace 23 is 850° C. or less, one having a melting point higher than the fluidized bed temperature of the metals contained in the organic waste can be discharged together with the bed material from the bottom of the low temperature gasification furnace as a valuable metal in the unoxidized state. When the internal furnace temperature of the low temperature gasification furnace 23 is 450° C. or more, while the formation of tar and char is suppressed, the gasification proceeds efficiently.

The internal furnace pressure of the low temperature gasification furnace 23 is preferably 0.5 MPaG (gauge pressure) or more and 9.0 MPaG or less, and more preferably 1.0 MPaG or more and 2.0 MPaG or less. When the internal furnace pressure of the low temperature gasification furnace 23 is 9.0 MPaG or less, the gasification treatment can be economically carried out without excessively increasing the facility cost from the viewpoint of pressure resistance and heat resistance. When the internal furnace pressure of the low temperature gasification furnace 23 is 0.5 MPaG or more, the facility can be miniaturized as compared with the case where the gasification treatment is carried out at normal pressure.

The bed material is discharged together with noncombustibles through a lock hopper 25 from the bottom of the low temperature gasification furnace 23, and coarse noncombustibles d are removed by a screen 26. A bed material c from which the noncombustibles have been removed is returned to the inside of the low temperature gasification furnace 23. A metal (for example, iron, copper, aluminum, etc.) contained in the separated coarse noncombustibles d is mostly in an unoxidized state, since the fluidized bed 24 is at relatively low temperature, and additionally in a state of being deficient in oxygen.

The combustible carbonaceous (solid carbon) formed by partial combustion of organic waste is finely pulverized by the stirring motion of the fluidized bed 24 to become particles (char), and conveyed by a flow of the organic raw material. A portion of the non-combustible material (ash) is also finely pulverized by the stirring motion of the fluidized bed 24 to become particles, and conveyed by a flow of the organic raw material.

An organic raw material e accompanied by the particles containing a non-combustible material and the combustible carbonaceous particles in a suspended state is supplied from the organic raw material inlet 3 of the high temperature gasification furnace 27 to the combustion chamber 1, and descends while swirling. The organic raw material and the combustible carbonaceous particles are combusted by a gasification agent (mixed gas of oxygen gas and water vapor) f supplied from the gasification agent inlet 4 and the top gasification agent inlet 5. The temperature in the combustion chamber 1 is maintained at 1,300 to 1,500° C. by the heat of combustion of the organic raw material and the combustible carbonaceous particles. Carbon monoxide gas and carbon dioxide gas are firmed by the combustion of the combustible carbonaceous particles. Carbon monoxide gas and hydrogen gas are also formed by an aqueous gasification reaction between water vapor contained in the gasification agent and the combustible carbonaceous particles.

The particles containing the non-combustible material contained in the organic raw material e become molten slag in the combustion chamber 1. The syngas (hydrogen gas, carbon monoxide gas, and carbon dioxide gas), and the molten slag are quenched in the non-combustible material separation chamber 12, the syngas is taken out from the gas extraction port 17, and slag grains (coarse grained slag) is taken out from the slag outlet 18.

When the organic raw material e is accompanied by a large amount of solid matter (combustible carbonaceous particles, or a non-combustible material), it is preferable that gas and the solid matter be separated by using a cyclone, etc., in advance before being supplied to the high temperature gasification furnace 27, and the gas be introduced from the organic raw material inlet 3, and the solid matter from the top gasification agent inlet 5 together with a gasification agent f, into the combustion chamber 1 of the high temperature gasification furnace 27. By introducing the solid matter separated by the cyclone into the combustion chamber 1 of the high temperature gasification furnace 27 together with the gasification agent f, the combustible carbonaceous particles in the solid matter preferentially comes into contact with the gasification agent, so that the generation amount of unburned carbon can be reduced.

Syngas h taken out from the gas extraction port 17 of the high temperature gasification furnace 27 is washed by a scrubber 31, and a trace amount of slag (slag mist) remaining in and conveyed by the syngas h is removed. Carbon monoxide gas and hydrogen gas contained in the syngas h' washed by the scrubber 31 can be utilized as various chemical industrial raw materials. Hydrogen gas obtained by gasifying the organic waste in the two-stage gasification system can also be used as a hydrogen source for ammonia synthesis. The slag collected by the scrubber 31 is sedimented and concentrated in a storage tank 32, and discharged to the outside as fine slag $g_f$. Since the fine slag contains a large amount of combustible carbonaceous particles, it is preferable to re-supply the fine slag to the high temperature gasification furnace.

On the other hand, the slag grain g taken out from the slag outlet 18 of the high temperature gasification furnace 27 is discharged to a storage tank 29 by a lock hopper 28 as appropriate. The coarse grained slag collected here is separated from water by a screen 30. The coarse grained slag $g_c$ can be used as a material for cement, civil engineering and construction.

An alkali metal-containing compound m can be directly charged into the high temperature gasification furnace 27 through the inlet for an alkali metal-containing compound 10 provided in the high temperature gasification furnace 27. The alkali metal-containing compound m may be introduced in the middle of the line connecting the low temperature gasification furnace 23 and the high temperature gasification furnace 27, whereby the alkali metal-containing compound may be charged into an organic raw material, Carbon monoxide gas and hydrogen gas contained in the syngas taken out from the gas extraction port 17 of the high temperature gasification furnace can be utilized as various chemical industrial raw materials. For example, using the syngas as a starting material, hydrogen gas may be obtained by a CO conversion reaction in order to produce ammonia gas.

EXAMPLES

In the following examples, specific embodiments of the present disclosure are illustrated, but the present invention is not limited thereto. All parts and percentages are in terms of mass, unless otherwise specified.

<Reagent Used>

The following reagents were used as the alkali metal-containing compound:

Sodium silicate (manufactured by Toyo Keisan Soda Co., Ltd., $SiO_2$: 23.7 to 26%, $Na_2O$: 10.3 to 11.3%)

Sodium hydroxide (manufactured by JUNSEI CHEMICAL Co., Ltd., special grade)

<Softening Point, Melting Point, and Flow Temperature of Slag>

The softening point, melting point, and flow temperature of slag were measured in accordance with JIS M 8801:2004 using a Leitz heating microscope under a mixed gas atmosphere having a volume ratio of hydrogen:carbon dioxide of 1:1 for a sample obtained by pulverizing the slag into a fine powder using a mill, and ashing at 800° C. for 5 hours.

<Eluted amount of Cr>

The eluted amount of Cr when the refractory castable had been immersed in an immersion solution containing sodium silicate or sodium hydroxide was determined by the following procedure.

(1) Acid Decomposition 0.1 g of the immersion solution after immersing the refractory castable, 6 mL of phosphoric acid (manufactured by JUNSEI CHEMICAL Co., Ltd., special grade), 4 mL of hydrochloric acid (manufactured by JUNSEI CHEMICAL Co., Ltd., special grade), 2.5 mL of hydrofluoric acid (manufactured by JUNSEI CHEMICAL Co., Ltd., special grade 46% to 48%), and 2 mL of nitric acid (manufactured by KANTO CHEMICAL Co., Inc., nitric acid 1.42 EL for electronics industry) were put into a microwave decomposition vessel (manufactured by Actac Co., Ltd., MWS3+).

(2) Microwave Thermolysis

Microwave thermolysis of the solution contained in the microwave decomposition vessel was repeated 2 times in the following series of operations (i) to (iv) to obtain an acid decomposition solution.

(i) Raise to 190° C. in 5 minutes, and maintain at 190° C. for 5 minutes (ii) Raise to 210° C. in 2 minutes, and maintain at 210° C. for 5 minutes (iii) Raise to 230° C. in 2 minutes, and maintain at 230° C. for 25 minutes (iv) Lower to 100° C. in 1 minute (3) ICP-AES analysis The total amount of the acid decomposition solution obtained by the microwave thermolysis was transferred to a 250 mL volumetric flask, ultrapure water (manufactured by Merck Co., Ltd., Direct-Q UV) was added up to 250 mL, 10 mL was collected from the dilution, further ultrapure in water was added up to 100 mL, and the obtained dilution was used as an analytical sample. The analytical sample was measured using ICP-AES (manufactured by Shimadzu Corporation, ICPS-8100) in accordance with ES K 0116:2014 to quantify the eluted amount of Cr.

1. Depression of Softening Point, Melting Point, and Flow Temperature of Slag by Addition of Alkali Metal-Containing Compound A softening point, a melting point, and a flow temperature were determined using slag collected from the bottom of the high temperature gasification furnace of the two-stage gasification system shown in FIG. 2 (actual slag 1 to 3, no alkali metal-containing compound was charged), and actual slag 1 or 3 to which the alkali metal-containing compound shown in Table 1 had been added. The compositions and measurement results of the slags are shown in Table 1.

| | Conditions | Composition (% by mass) | | | | Molar ratio | | | Softening point (° C.) | Melting point (° C.) | Flow temperature (° C.) |
|---|---|---|---|---|---|---|---|---|---|---|---|
| | | $SiO_2$ | $Al_2O_3$ | $Na_2O$ | $Fe_2O_3$ | $SiO_2/Al_2O_3$ | $Na_2O/Al_2O_3$ | $SiO_2/Na_2O$ | | | |
| Ex. 1 | Acutal slag 1 to which sodium silicate had been added, 5% by mass in terms of $Na_2O$ | 41.5 | 14.1 | 4.9 | 4.0 | 4.9 | 0.6 | 8.7 | 1220 | 1339 | 1367 |
| Ex. 2 | Actual slag 1 to which sodium silicate had been added, 10% by mass in terms of $Na_2O$ | 48.2 | 11.0 | 10.2 | 3.1 | 1.8 | 1.5 | 4.9 | 1096 | 1183 | 1245 |
| Ex. 3 | Acutal slag 3 to which sodium hydroxide had been added, 5% by mass in terms of $Na_2O$ | 28.8 | 15.4 | 5.8 | 4.7 | 4.5 | 0.6 | 5.1 | 1180 | 1270 | 1315 |
| Ex. 4 | Actual slag 3 to which sodium hydroxide had been added, 8% by mass in terms of $Na_2O$ | 26.2 | 14.0 | 8.7 | — | 2.7 | 1.0 | 3.1 | 1194 | 1261 | 1315 |
| Ex. 5 | Actual slag 3 to which sodium hydroxide had been added, 10% by mass in terms of $Na_2O$. | 23.3 | 12.5 | 11.1 | | 1.9 | 1.5 | 2.2 | 1213 | 1261 | 1294 |
| Ref Ex. 1 | Actual slug 1 | 36.2 | 16.5 | 1.1 | 4.7 | 25.5 | 0.1 | 33.9 | 1295 | 1382 | 1390 |
| Ref Ex. 2 | Actual slug 2 | 37.1 | 16.3 | 1.3 | 4.5 | 21.3 | 0.1 | 29.4 | 1265 | 1369 | 1381 |
| Ref Ex. 3 | Actual slug 3 | 30.8 | 16.5 | 1.3 | — | 21.5 | 0.1 | 24.4 | 1322 | 1388 | 1407 |

In Examples 1 to 5, all of the softening point, the melting point, and the flow temperature were lower than those of Reference Examples 1 to 3.

2. Material Test for Refractory Material

A refractory castable (10 cm×10 cm×10 cm) was calcined in an electric furnace at 110° C. for 3 hours, and at 1,000° C. for 3 hours, and immersed in 300 g of immersion solution, and then the Cr concentration in the immersion solution was determined. The results are shown in Table 2.

TABLE 2

| Immersion solution | Sodium silicate No. 1 prescribed in JIS K1408-1966 | 25% by mass solution of sodium hydroxide |
|---|---|---|
| Cr concentration (mg/L) | 0.0 | 4.0 |

When sodium silicate was used as the immersion solution, elution of the Cr component of the refractory (astable was not confirmed, while when an aqueous sodium hydroxide solution was used, elution of the Cr component was confirmed.

3. Actual Machine Test for Refractory Material

While the two-stage, gasification system shown in FIG. 2 was operated with the throughput of organic waste being 5 t/h, the gas temperature at the outlet of the combustion chamber of the high temperature gasification furnace being 1,450° C., and the internal furnace pressure being 0.9 MPaG, sodium silicate was directly charged into the high temperature gasification furnace through the side pipe (the inlet for an alkali metal-containing compound) of the high temperature gasification furnace at a supply rate of 100 L/h, and the two-stage gasification system was operated for 6 months. When the high temperature gasification furnace was opened after the shutdown, no effect on the refractory material was found.

While the two-stage gasification system shown in FIG. 2 was operated with the throughput of organic waste being 5 t/h, the gas temperature at the outlet of the combustion chamber of the high temperature gasification furnace being 1,450° C., and the internal furnace pressure being 0.9 MPaG, an aqueous sodium hydroxide solution was directly charged into the high temperature gasification furnace through the side pipe (the inlet for an alkali metal-containing compound) of the high temperature gasification furnace at a supply rate of 150 L/h, and the two-stage gasification system was operated for 0.5 months. When the high temperature gasification furnace was opened after the shutdown, the thickness of the refractory material decreased.

REFERENCE SIGNS LIST

1 Combustion chamber
2 Side wall
3 Organic raw material inlet
4 Gasification agent inlet
5 Top gasification agent inlet
6 Steel outer
7 Cooling jacket
8 Bottom
9 Opening
10 Inlet for an alkali metal-containing compound
11 Throat portion
12 Non-combustible material separation chamber
13 Cooling water inlet pipe
14 Cylindrical downcomer
15 Cylindrical riser tube
16 Water tank portion
17 Gas extraction port
18 Slag outlet
19 Cooling water extraction port
23 Low temperature gasification furnace
24 Fluidized bed
25 Lock hopper
26 Screen
27 High temperature gasification furnace
28 Lock hopper
29 Storage tank
30 Screen
31 Scrubber
32 Storage tank

The invention claimed is:

1. A method for operating a gasification furnace in which an organic raw material is charged to form gas and slag, comprising charging an alkali metal-containing compound directly or indirectly into the gasification furnace to reduce the viscosity of the slag, the method characterized by comprising:

analyzing the content of sodium and silicon of the slag, determining, based on the analyzed content, a molar ratio of silicon dioxide and sodium oxide in the slag (the number of moles of silicon dioxide/the number of moles of sodium oxide); and maintaining the molar ratio of silicon dioxide and sodium oxide in the slag to be 2.5 or more, by controlling charging of the alkali metal-containing compound based on the determined molar ratio, wherein the controlling comprises charging the alkali metal-containing compound when the molar ratio of silicon dioxide and sodium oxide in the slag is 2.5 or less, wherein the alkali metal-containing compound is sodium silicate.

2. The method according to claim 1, wherein the sodium silicate is charged in the form of an aqueous solution.

3. The method according to claim 1, wherein the molar ratio of silicon dioxide and sodium oxide in the sodium silicate (the number of moles of silicon dioxide/the number of moles of sodium oxide) is 0.4 or more and 4.5 or less.

4. The method according to claim 1, comprising charging a silicon containing compound directly or indirectly to the gasification furnace.

5. The method according to claim 4, wherein the silicon containing compound is a bed material.

6. The method according to claim 1, wherein the molar ratio of silicon dioxide and sodium oxide (the number of moles of silicon dioxide/the number of moles of sodium oxide) in the slag having a reduced viscosity is 2.5 or more and 15.0 or less.

7. The method according to claim 1, wherein the slag having a reduced viscosity comprises an alkali metal in an amount of 1.5% by mass to 20.0% by mass in terms of oxide.

8. The method according to claim 1, comprising mixing the alkali metal-containing compound with the organic raw material, and charging the mixture into the gasification furnace.

9. A method for two-stage gasifying organic waste, comprising forming an organic raw material by primary gasification of the organic waste in a low temperature gasification furnace, charging the organic raw material into a high temperature gasification furnace, forming gas and slag by secondary gasification of the organic raw material in the high temperature gasification furnace, and charging an alkali metal-containing compound directly or indirectly into the high temperature gasification furnace to reduce the viscosity of the slag, the method characterized by comprising:

analyzing the content of sodium and silicon of the slag, determining, based on the analyzed content, a molar ratio of silicon dioxide and sodium oxide in the slag (the number of moles of silicon dioxide/the number of moles of sodium oxide); and maintaining the molar ratio of silicon dioxide and sodium oxide in the slag to be 2.5 or more, by controlling charging of the alkali metal-containing compound based on the determined molar ratio, wherein the controlling comprises charging the alkali metal-containing compound when the molar ratio of silicon dioxide and sodium oxide in the slag is 2.5 or less, wherein the alkali metal-containing compound is sodium silicate.

10. The method according to claim 9, wherein the high temperature gasification furnace is a gasification furnace for forming gas and slag from an organic raw material, comprising a combustion chamber for gasifying or combusting the organic raw material, a non-combustible material separation chamber for cooling and recovering the formed slag, and an inlet for an alkali metal-containing compound provided in the combustion chamber.

11. The method according to claim 9, wherein the low temperature gasification furnace is a fluidized bed gasification furnace.

* * * * *